US010166656B2

(12) United States Patent
Richardson

(10) Patent No.: US 10,166,656 B2
(45) Date of Patent: Jan. 1, 2019

(54) HOLD-DOWN CLAMPING APPARATUS

(71) Applicant: Imagine TF, LLC, Los Gatos, CA (US)

(72) Inventor: Brian E. Richardson, Los Gatos, CA (US)

(73) Assignee: IMAGINE TF, LLC, Los Gatos, CA (US)

( * ) Notice: Subject to any disclaimer, the term of this patent is extended or adjusted under 35 U.S.C. 154(b) by 45 days.

(21) Appl. No.: 15/204,722

(22) Filed: Jul. 7, 2016

(65) Prior Publication Data

US 2017/0008154 A1 Jan. 12, 2017

Related U.S. Application Data

(60) Provisional application No. 62/231,535, filed on Jul. 8, 2015.

(51) Int. Cl.

| | |
|---|---|
| ***B25B 5/14*** | (2006.01) |
| ***B25B 1/10*** | (2006.01) |
| ***B25B 5/00*** | (2006.01) |
| ***B25B 1/24*** | (2006.01) |

(52) U.S. Cl.

CPC ..... *B25B 5/145* (2013.01); *B25B 1/103* (2013.01); *B25B 1/2457* (2013.01); *B25B 1/2473* (2013.01); *B25B 5/003* (2013.01)

(58) Field of Classification Search

CPC ..... B25B 1/20; B25B 1/2457; B25B 1/2463; B25B 1/2468; B25B 1/2478; B25B 5/145; B25B 5/163

See application file for complete search history.

(56) References Cited

U.S. PATENT DOCUMENTS 1,578,898 A * 3/1926 Littleford ..... B25B 5/145 269/114
2,365,436 A * 12/1944 Saucier ..... B23Q 1/525 236/1 E
2,654,932 A * 10/1953 Goudie ..... B25B 5/06 24/523
2,770,156 A * 11/1956 Brettrager ..... B25B 1/2452 269/268
2,832,395 A * 4/1958 Fisher ..... B25B 1/24 269/265
3,423,885 A * 1/1969 Crandall ..... B23Q 3/104 269/902

(Continued)

*Primary Examiner* — Tyrone V Hall, Jr.
(74) *Attorney, Agent, or Firm* — Thomas Schneck

(57) ABSTRACT

A hold-down clamping apparatus comprising a hold-down clamp with body having a top lip and pair of guide legs disposed between a central screw in the body and a support having holes in vertical alignment with the legs and the screw for securing and holding down a sheet material for processing. The screw is threaded through the support screw hole as the legs are inserted within support holes until the top lips contacts the sheet material to hold down the material and to prevent twisting of the hold-down clamp. Supports with clamps may be fastened to tools or supports. In one embodiment, the support has a grid of holes for securing a plurality of materials with hold-down clamps. In another embodiment, the hold-down clamp comprises a top lip and a guide beam slotted in a support and secured.

2 Claims, 7 Drawing Sheets

(56) References Cited

U.S. PATENT DOCUMENTS

| | | | | | |
|---|---|---|---|---|---|
| 3,982,740 | A * | 9/1976 | Gutman | B25B 1/2452 | 269/110 |
| 4,519,592 | A * | 5/1985 | Russell | B25B 1/18 | 269/25 |
| 4,830,350 | A * | 5/1989 | Kuei | B25B 5/163 | 269/271 |
| 4,948,108 | A * | 8/1990 | Sullivan | H05K 13/0061 | 269/304 |
| 5,244,194 | A * | 9/1993 | Nishimura | B25B 1/2452 | 269/155 |
| 5,562,277 | A * | 10/1996 | Swann | B23Q 3/103 | 269/152 |
| 6,000,688 | A * | 12/1999 | Giangrasso | B23Q 3/104 | 269/252 |
| 6,196,536 | B1 * | 3/2001 | Hintze | B25B 1/103 | 269/266 |
| 6,554,265 | B2 * | 4/2003 | Andronica | B25B 1/2452 | 269/268 |
| 6,672,578 | B1 * | 1/2004 | Martens | B25B 1/2452 | 269/261 |
| 6,773,003 | B2 * | 8/2004 | Dermody, Jr. | B25B 1/241 | 269/268 |
| 6,896,249 | B1 * | 5/2005 | Ferrara | B25B 1/12 | 269/138 |
| 7,152,855 | B1 * | 12/2006 | Martens | B25B 1/2468 | 269/283 |
| 7,568,683 | B1 * | 8/2009 | Lovas | B25B 1/2463 | 269/43 |
| 8,540,225 | B2 * | 9/2013 | Ehnstrom | B25B 1/2405 | 269/242 |
| 9,448,537 | B2 * | 9/2016 | Lindsay | G04D 1/025 | |
| 2011/0089621 | A1 * | 4/2011 | Seidel | B25B 5/003 | 269/46 |

* cited by examiner

HOLD-DOWN CLAMPING APPARATUS

CROSS-REFERENCE TO RELATED APPLICATION

The present application claims the benefit of priority from prior U.S. provisional application 62/231,535 filed on Jul. 8, 2015, which is hereby incorporated by reference.

TECHNICAL FIELD

The invention relates to clamps and more particularly to a hold-down clamping apparatus for securing and holding down a sheet material for processing.

BACKGROUND ART

Various mechanisms for supporting and clamping sheet materials to be processed by a tool or otherwise are known in the art. Vises and supports such as X-Y tables and work benches as well machine tools and robotic tools and parts thereof are often employed to hold sheet materials of different shapes and sizes to be processed by a tool or otherwise. There have been difficulties with sufficiently securing sheet materials to a tool or portion of a tool or to a support resulting in movement of the work sheet and imprecise processing.

Additionally, sheet materials can be deformed where vises and the like are used to constrain the work material. Kurt Manufacturing provides a vise with interchangeable jaws that can be replaced when damaged. The jaws of the vise apply significant force to the material being held as the axis being constrained by the vise is a function of the friction between the vise jaws and the sheet material. When the sheet material is thin in cross-section or flexible it can be deformed significantly resulting in imprecise processing. Even thicker and/or more rigid sheet materials may buckle or deform somewhat when constrained by vise jaws resulting in vibration and poor tolerance control at the center of the sheet material.

It is therefore an object of the present invention to secure and/or to provide an apparatus to secure sheet material for use in machining or processing.

It is a further object of the invention to prevent and/or to provide an apparatus capable of preventing deformation to secured sheet material for machining or processing.

It is an additional object to provide a clamping apparatus for securing and holding down sheet material for machining or processing.

SUMMARY DISCLOSURE

These objects, as well as others, have been achieved with a hold-down clamping apparatus comprising a sheet material support plate and a hold-down clamp for securing and holding-down sheet material for processing or machining. The hold-down clamp has a body with a top lip, a pair of downwardly depending guide legs, and a central clamping screw disposed in the central screw hole between the pair of guide legs. The sheet material support plate has holes in vertical alignment with the pair of guide legs and the central screw. The pair of guide legs is inserted within the support plate holes and the central screw is threaded into its support plate hole as the top lip of the hold-down clamp is positioned into contact with the material support and presses against a sheet material disposed on the support plate, typically an edge portion, so as to hold down the material to prevent deformation, to secure the material and to prevent twisting of the hold-down clamp. The sheet material may be thin or thick and of any dimension. In one example, the sheet material is rectangular in shape. In another example, the sheet material is a block. In one example, the hold-down clamping apparatus may be fastened to a vise where a clamping force along a different axis may additionally be applied. In other examples, the clamp-down apparatus may be fastened to supports such X-Y tables and work benches as well as to machines or robotic tools.

In one embodiment, the clamp-down apparatus includes a first clamping assembly comprising a hold-down clamp and a first sheet material support and a second clamping assembly comprising an opposing second hold-down clamp and an opposing second sheet material support for securing and holding down a sheet material extending from the first sheet material support to the second sheet material support. A material sheet is placed on the material supports and extends from one material support to the other. First guide legs are inserted and a first central screw is threaded in holes in the first material support and second guide legs are inserted and a second central screw is threaded in holes of the second material support. Guide legs of each of the hold-down clamps are inserted in holes corresponding to a cross-sectional shape of the guide legs and the central screws are threaded in central screw holes as the top lips of the clamps are positioned into contact with and press against portions of the sheet material to hold it down and in place and so that twisting of the hold-down clamps is prevented. Additional holes and hold-down clamps disposed linearly along the material supports may be used to further secure and hold down the material sheet. In one example, the hold-down clamping apparatus is used with a vise. The first sheet material support abuts a first jaw of a vise and the second sheet material support abuts a second jaw of a vise so that a clamping force along a different axis may also be applied.

In another embodiment, the hold-down clamping apparatus includes a different clamping assembly comprising a hold-down clamp having a body with a top lip and a downwardly depending rectangular guide beam having a central screw hole, a central screw disposable within the central screw hole, a sheet material support having a guide beam slot in vertical alignment with the guide beam and corresponding to a rectangular cross-sectional shape of the guide beam, and a central screw hole in a block beneath the slot in vertical alignment with the central screw guide beam hole. The sheet material is disposed on the sheet material support and the guide beam is inserted within the guide beam slot until the top lip of the hold-down clamp contacts the support at which point the screw is threaded into the central screw hole beneath the slot so that the lip presses upon the sheet material to prevent twisting of the clamp and deformation of the sheet material. A pair of these clamping assemblies may replace the clamping assembly described above and may be integrated with a vise or other tool.

In another embodiment, the clamping apparatus comprises a sheet material support sized to support multiple sheet materials on the upper surface and having a grid pattern of holes in the support within which select holes the guide legs and central screws of hold-down clamps may be inserted to hold-down multiple sheet materials at different, selected positions. Processing of multiple sheet materials provides greater productivity. Also, the ability to select positions for the hold-down clamp allows for different sized sheet materials to be accommodated. In one example, all of the holes are threaded at the bottom and the central screw is longer than the guide legs so that the central screw may be threaded into the bottom portion of any selected hole to hold down the sheet material upon which the top lip presses against and to prevent twisting of the clamp. In other examples, only select holes may be threaded in which case the hold-down clamp would be used at particular positions where the central screw would be threadable in that hole.

DETAILED DESCRIPTION

Figure 1:
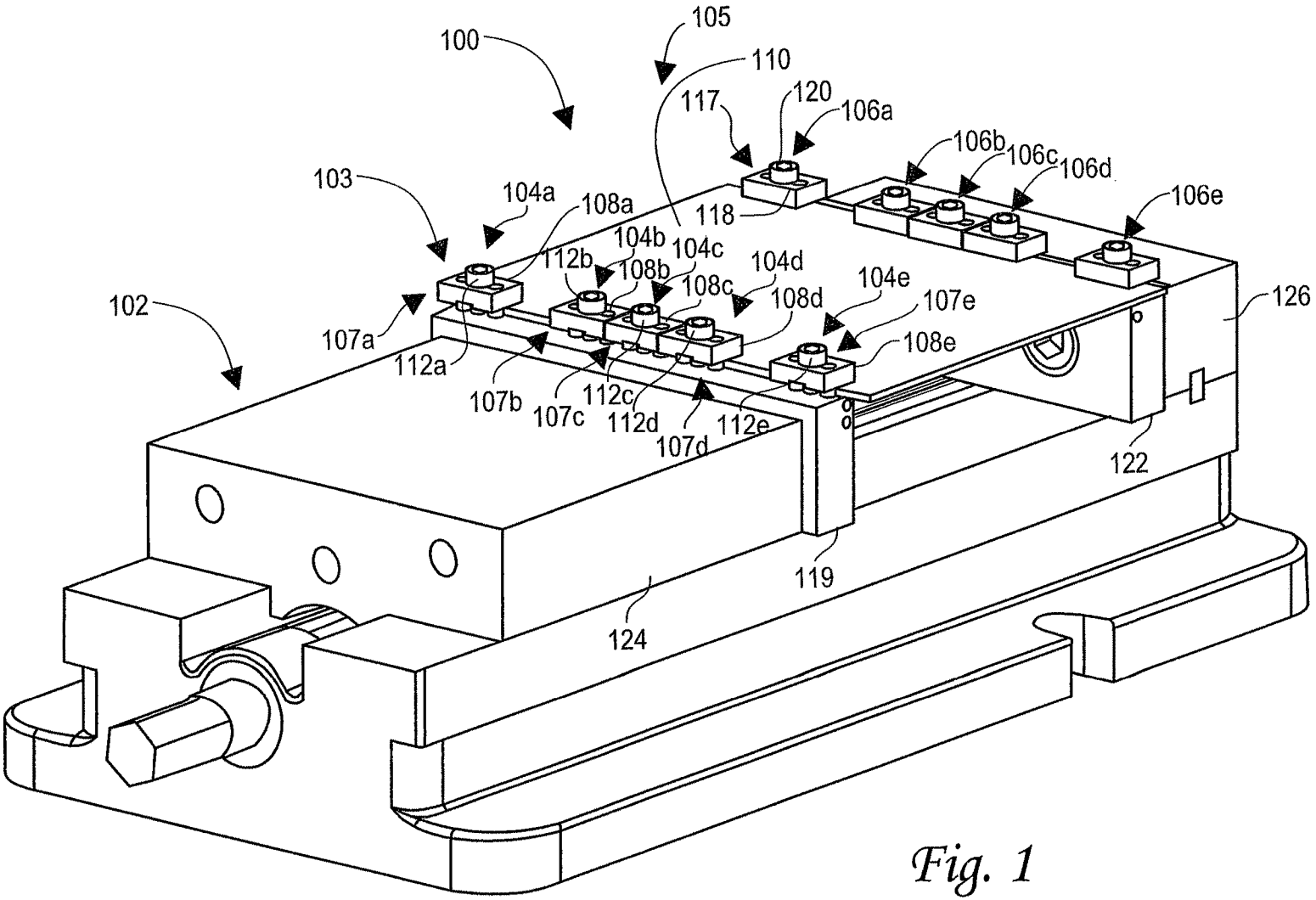
FIG. 1 is perspective view of a hold-down clamping apparatus of the present invention in use with a tool and a thin sheet material.

With reference to FIGS. 1-4, there is seen a hold-down clamping apparatus 100 of the present invention integrated with a tool, in this example, vise 102. The hold-down clamping apparatus, comprises, in one embodiment, a pair of opposed clamping assemblies 103 and 105, each assembly having at least one hold-down clamp and a material support. With reference to clamping assembly 103, hold-down clamps 104*a-e* are shown each respectively with a body 107A-e, a top lip 108*a-e*, a pair of downwardly depending guide legs 400*a-e*, and a clamping central screw 112*a-e* disposed in and secured to a body 107A-e between the pair of guide legs 400*a-e* and a sheet material support 119 having a pair of holes 404*a-e* in vertical alignment with the pair of guide legs 400*a-e* and a threaded hole 406*a-e* in vertical alignment with the central screw 112*a-e* and the central screw hole 402*a-e*.

With reference to clamping assembly 105, hold down clamps 106*a-e* have the same structure as hold-down clamps 104*a-e*. Labeled on clamp 106*a* is a body 117, top lip 118, a pair of downwardly depending guide legs 200, and a central screw 120 disposed in and secured to the body between the pair of guide legs 200 and a material sheet support. 122 having a pair of holes in 308 in vertical alignment with the pair of guide legs 200, and a central threaded screw hole 301 in vertical alignment with the central screw 120. Guide legs and central screws for clamps 106*b-e* also have corresponding holes in the support, as for clamp 106*a*, though are not shown here.

The sheet material 128 may be positioned against the guide legs of each hold-down clamp and where the guide legs are aligned with the lateral plane of the tool or vise jaws 124 and 126, the sheet material is also aligned with the vise 102. Hold-down clamps 104*a* and 106*a* hold down and secure sheet material 128 to first and second sheet material supports 119 and 122 in between which sheet material 128 extends.

Figure 2:
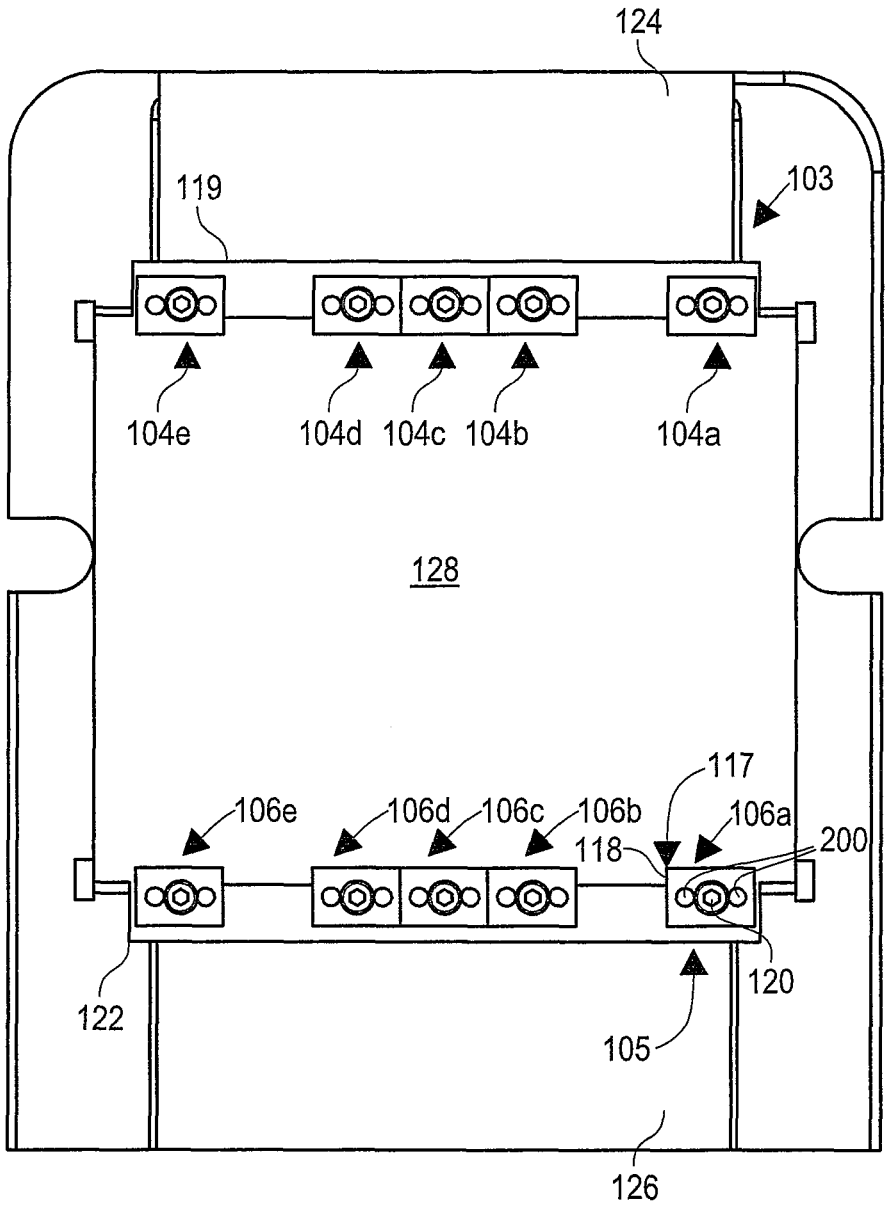
FIG. 2 is a top view of the hold-down clamping apparatus and tool of FIG. 1.
Figure 3:
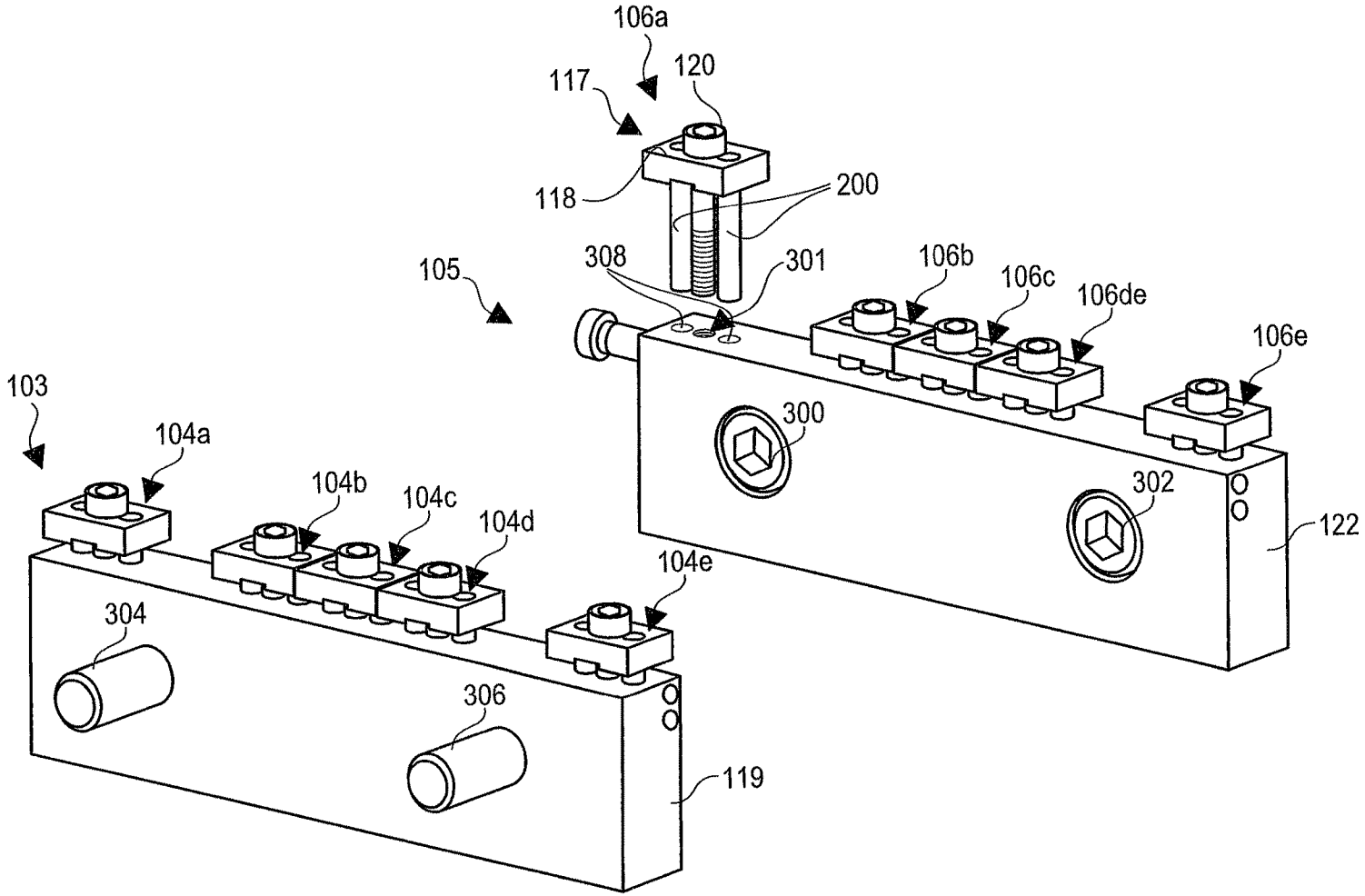
FIG. 3 is a perspective view of the hold-down clamping apparatus of FIG. 2 including two hold-down clamping assemblies.
Figure 4:
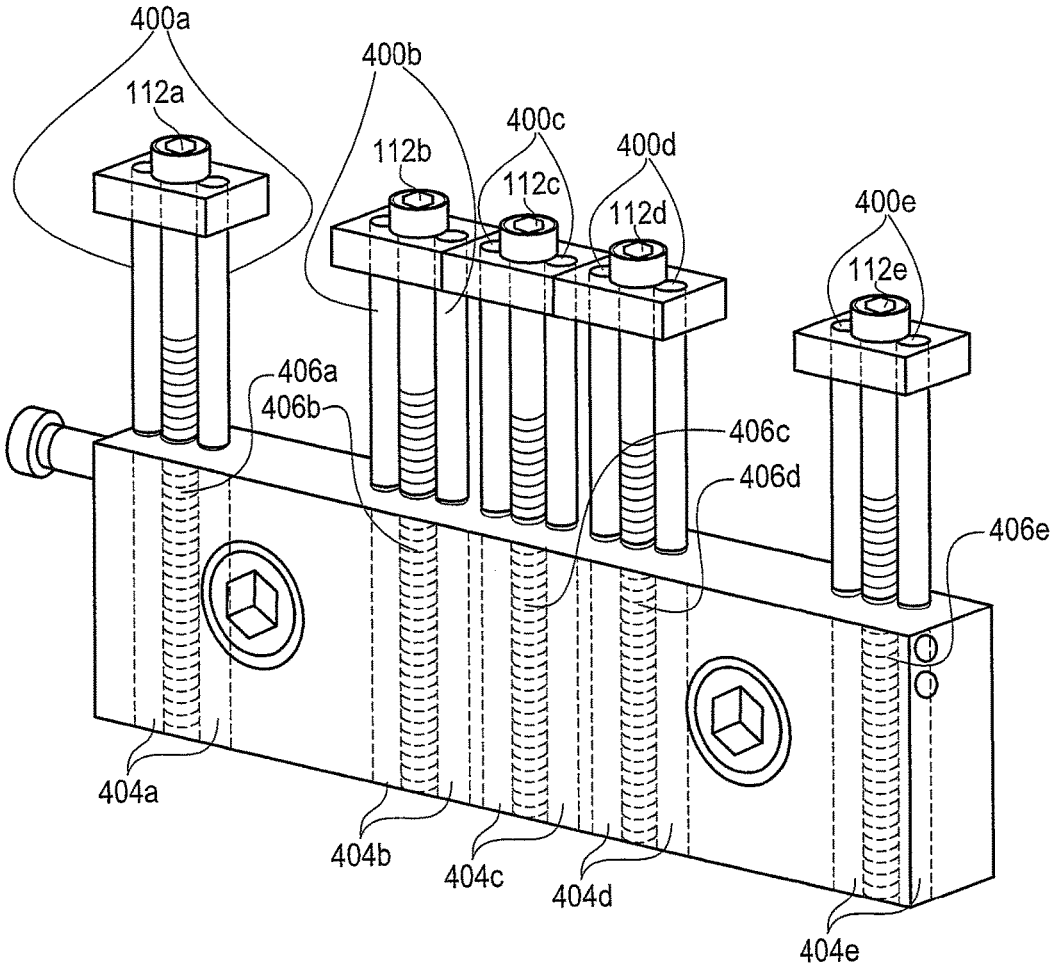
FIG. 4 is a perspective view of a clamping assembly of the hold-down clamping apparatus of FIG. 3 with hold-down clamps in a different position.

With reference to FIGS. 2-4, for each hold-down clamp 104*a* and 106*a*, the pair of guide legs is inserted within the pairs of sheet material support holes 404*a* and 308 respectively, which constrain the motion of the hold-down clamps to only vertical motion, and the central screws 112*a* and 120 are threaded in sheet material support screw holes 406*a* and 301, respectively, so that the hold-down clamp moves down and so that the top lip of each hold-down clamp contacts a sheet material 128 disposed on the supports 119 and 122. Central screws are threaded in the support screw holes to tighten the hold-down clamps against the sheet material and sheet material supports 119 and 122, respectively, securing the sheet material 128 in place and holding it down. Top lips 108*a* and 118 each apply force to the sheet material 128, typically an edge portion of the sheet material. The size of each top lip should be sufficient to retain the sheet material 128 but not so big that it covers a large portion of the sheet material which is to be worked on or processed. In one example the lip should not extend more than 5 mm over the edge portion of the sheet material to be worked on. In one example, the sheet material is secured by one pair of opposing clamps 104*a* and 106*a*. However, additional clamps 104*b*-104*e* in linear arrays along sheet material support 119 and opposing clamps 106*b*-106*e* along sheet material support 122 may be used to hold-down the sheet material 128. In another example, only one hold-down clamp is used with one sheet material support.

Referring to FIGS. 3 and 4, pairs of guide leg holes, for example 404*a* and 308, correspond to a cross-sectional shape of respective pairs of guide legs 400*a* and 200. Each central screw 112*a* and 120 is threaded in a corresponding central screw hole 406*a* and 301, respectively, as the guide legs are inserted in the support holes. In one example, guide legs comprise pins or shafts which have a friction fit in holes in the clamp body. In this example, the guide legs and the central screw are the same length. In each set of three holes, the central screw hole is threaded all the way through and the central screw is either completely threaded or threaded at a lower portion so as to secure the sheet material to the sheet material support and hold it down and to prevent twisting of the hold-down clamp. The holes for the pair of guide legs may or may not be threaded. In another example, the central screw may be longer than the guide legs and is received within a hole that is threaded at a lower portion beneath leg length and at a length of the screw so as to secure the hold-down clamp and sheet material to the sheet material support and to prevent twisting of the hold-down clamp.

Referring to FIG. 3, sheet material supports have bolt assemblies for bolting the sheet material supports 119 and 122 to tools or supports allowing for connection with tools other supports. Support retention bolt holes 300 and 302 of support 122 are seen but not bolts and bolts 304 and 306 of support 119 are seen but not the openings. Referring to FIG. 1, the first sheet material support 119 abuts jaw 124 of the vise 102 and the second sheet material support 122 abuts jaw 126 of the vise 102 so that a clamping force along an x-axis may also be applied. The additional clamping force makes for easier cutting and allows for increased cutting rates.

Figure 5:
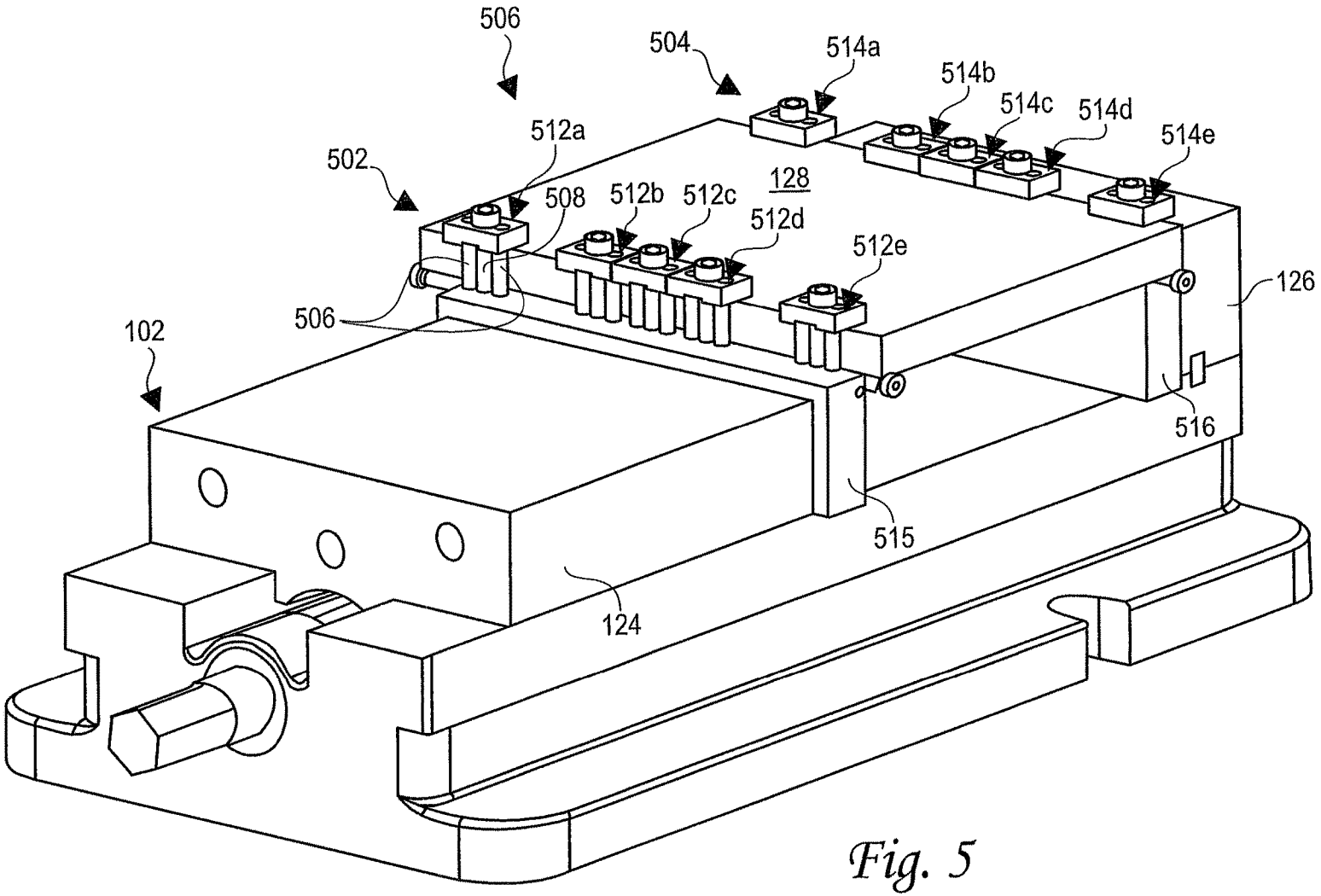
FIG. 5 is a perspective view of a hold-down clamping apparatus and tool in use with a thicker sheet material.

Referring to FIG. 5, clamping apparatus 500 fastened to vise 102 is seen, the apparatus having an opposed pair of clamping assemblies 502 and 504 with each hold-down clamp of the clamping assemblies having a pair of guide legs and a central screw longer than pairs of guide legs 400*a-e* and 200 and central screws 112*a-e* and 120 seen in FIG. 1 in order to hold-down thicker sheet material 510. As seen with regard to hold-down clamp 512*a*, more of the screw and pair of legs are visible outside the support because the length of the pair of guide legs 506 and central screw 518 is longer than pairs of guide legs 400*a-e* and 200 and than central screws 112*a-e* and 120 seen in FIG. 1 to hold down thicker sheet material 510. The length of the pairs of legs and screws are the same for each of the hold-down clamps 512*a-e* and 514*a-e*. For each hold-down clamp the length of each pair of guide legs and screw is selectable and may be dependent on the thickness of the sheet material used. The cross-sectional shape of the pairs of guide legs for each hold-down clamp of clamping assemblies 103 and 105 may be the same as the cross-sectional shape of the guide legs 400 and 308 of clamping apparatus 100. The screws of the hold-down clamp clamping apparatus 500 may be of a cross-sectional shape that fits within the screw holes of the hold-down clamp body and sheet material supports 119 and 122 of clamping assemblies 103 and 105, respectively. The legs in clamping apparatus 500 are longer so as to be insertable deep within holes of the sheet material supports 515 and 516 and the screws are longer to so as to be threadable deep within the central screw holes of the material supports 514 and 516 to hold down and secure the thicker sheet material and prevent the hold-down clamp from twisting.

Figure 6:
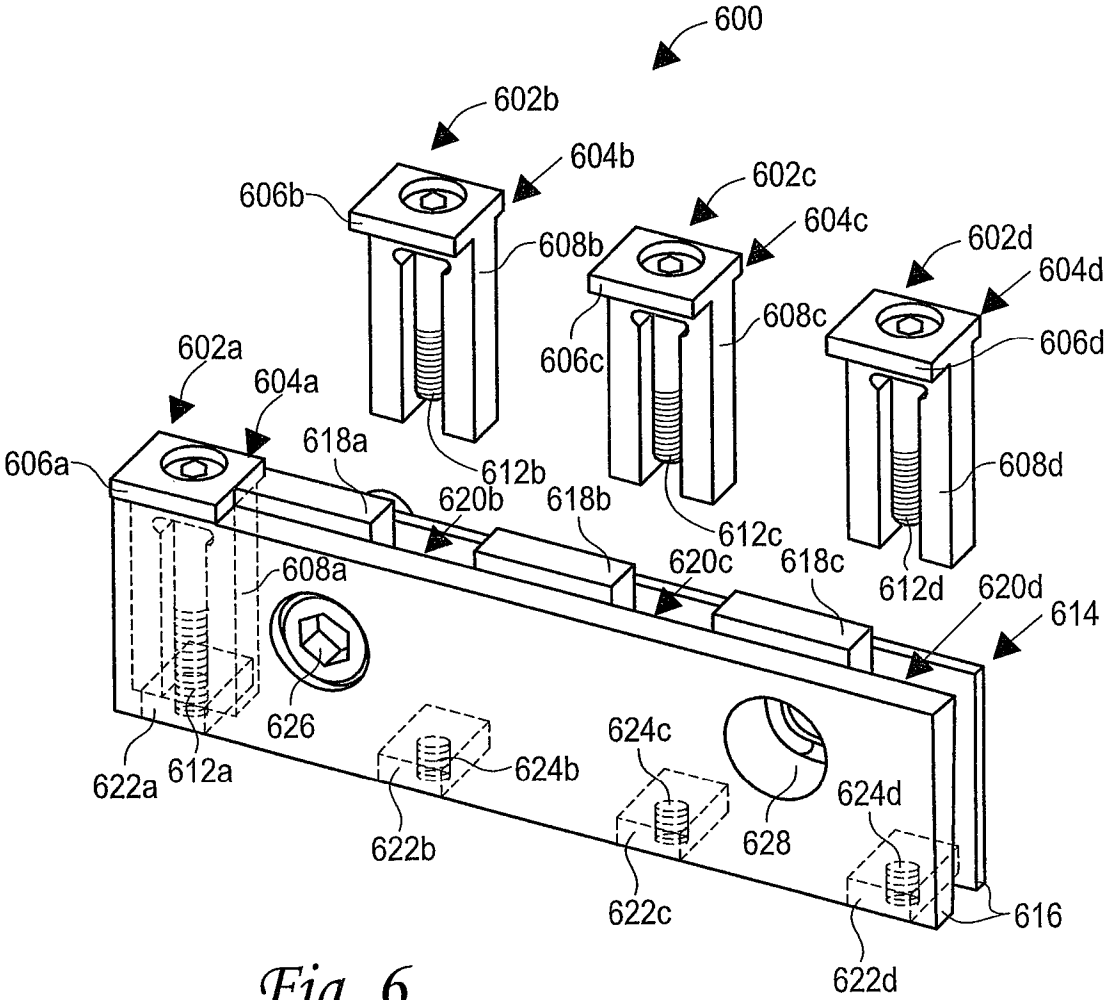
FIG. 6 is an alternate embodiment of a hold-down clamping assembly of the present invention.

With reference to FIG. 6, an alternate embodiment of a clamping assembly 600 is seen featuring one or more hold-down clamps. Each clamp 602*a-d* respectively has a body 604*a-d* with a top lip 606*a-d* and a downwardly depending rectangular guide beam 608*a-d* and a central screw 612*a* disposed within and constrained to limited vertical movement in the respective body 604*a-d* and a sheet material support 614 having guide beam slots 620*b-c*, each slot in vertical alignment with a corresponding guide beam 608*a-d* and corresponding to a rectangular cross-sectional shape of the guide beam. Each respective guide beam 608*a-d* has a U-shaped cross-section cutout within which a respective screw is disposed. In one example, the sheet material support 614 comprises a pair of plates 616 with spaced apart rectangular blocks 618*a-c* forming guide beam slots 620*a-d* between the pair of plates 616 within which respective slot 620 slots the guide beam 608. The guide beam slots constrain the guide beam motion to vertical only motion. A block 622*a-d* beneath a respective slot 620 has a threaded central screw hole, screw holes 624*b-d* seen, in vertical alignment with the corresponding central screw 612.

Though not shown here, a second opposing clamping assembly 600 comprising a material sheet support with a hold-down clamp with a rectangular beam, block and slot configuration is used to secure a sheet material on the opposite end of the clamping assembly, the sheet material extending in between the two material sheet supports for processing, as seen in FIG. 1. The clamp assembly 600 may replace the clamp assemblies of FIG. 1. As with the clamping assemblies of FIG. 1, one or more opposed pair of hold-down clamps may be used to hold-down the sheet material. However, additional hold-down clamps in linear arrays along sheet material supports may be used to hold-down the material sheet. For example, hold-down clamps 602*a-d* in linear arrays along the sheet material support 614 and opposing hold-down clamps in linear arrays in an opposing clamp assembly (not shown) may hold down and secure the sheet material to the sheet material support.

Each hold-down clamp 602*a-d* is insertable within the corresponding guide beam slot 620 until the top lip 606*a*-606*d* of the respective hold-down clamp 602*a*-602*d* rests upon a sheet material disposed on the support 614 at which point the corresponding central screw 612*a-d* is threadable within the respective central screw hole of the corresponding block 622*a-d*. Hold-down clamp 602*a* is shown inserted in its slot and screw 612*a* is shown threaded in its corresponding screw hole. For each-hold down clamp, the central screw is threaded into the central screw hole when the guide beam leg is in place in the slot and the top lip rests upon the sheet material thereby holding down the sheet material which the top lip contacts and preventing twisting of the hold-down clamp. The size of each top lip should be sufficient to retain the sheet material but not so big that it covers a large portion of the sheet material which is to be worked on or processed. In one example the lip should not extend more than 5 mm over the edge portion of the sheet material to be worked on.

This clamping assembly may be integrated with a tool such as vise 102 as seen in FIG. 1. Sheet material support 614 has support retention bolt holes 626 and 628 which allow for bolting of the sheet material support with bolts to tools allowing for integration or connection with tools or other supports. The sheet material support 614 may be positioned to abut jaw 124 of the vise 102 and a second sheet material support (not shown) of a second clamping assembly with a guide beam may be positioned to abut jaw 126 of the vise 102 so that a clamping force along an x-axis may also be applied. The additional clamping force makes for easier cutting and allows for increased cutting rates.

Figures 7A, 7B:
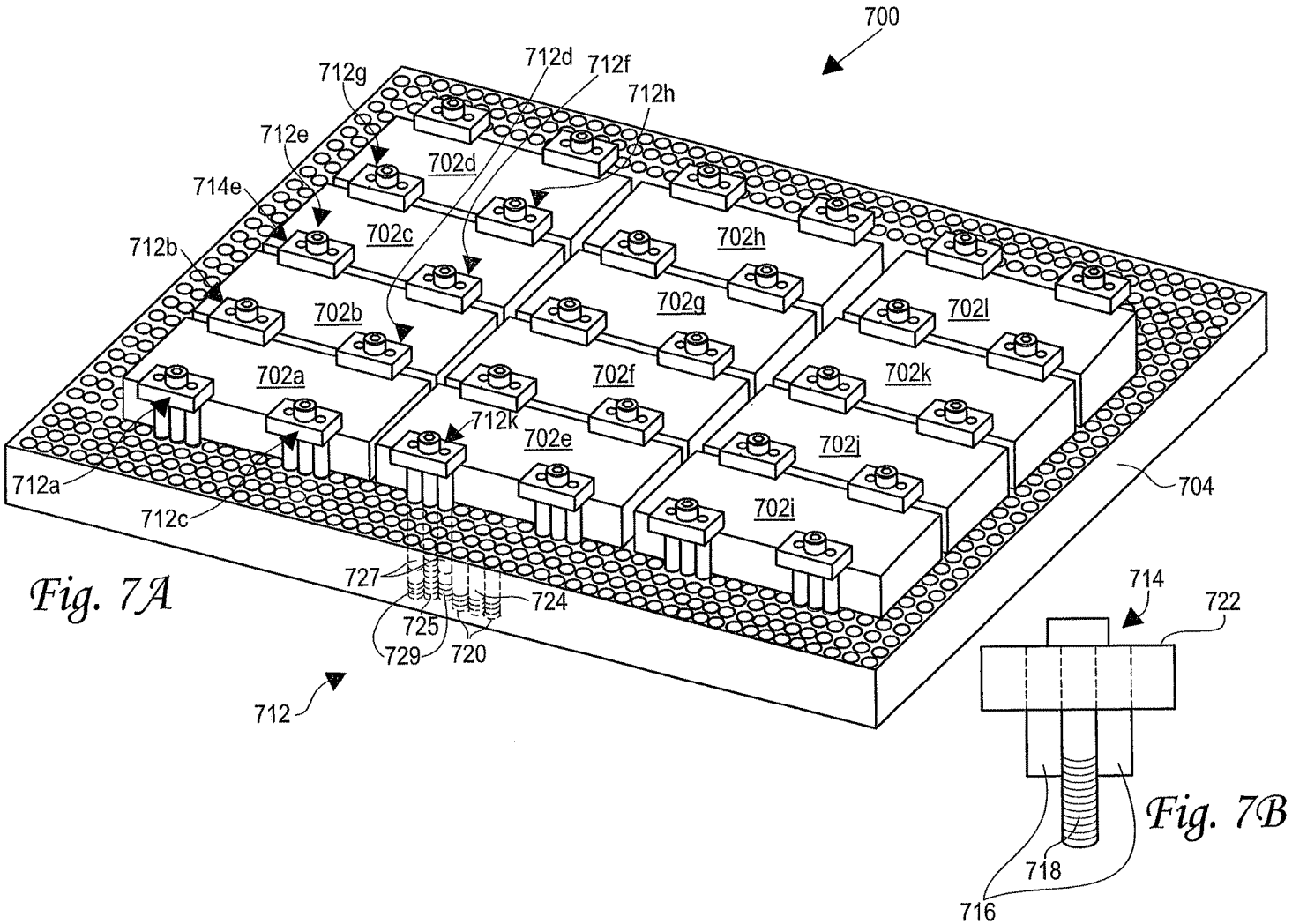
FIG. 7A is another alternate embodiment of a hold-down clamping apparatus of the present invention.
FIG. 7B is a plan view of a hold-down clamp of FIG. 7A.

With reference to FIGS. 7A and 7B, there is seen another embodiment of a hold-down clamping apparatus 700 capable of supporting one or a plurality of sheet materials 702*a-l*. The apparatus comprises sheet material support 704 having a pattern of holes 706 disposed in a pattern through the sheet material support 704 and at least one hold-down clamp 712, preferably, at least one pair of opposed hold-down clamps per sheet material to secure and hold down the sheet material 702. A plurality of sheet materials, for example sheet materials 702*a-l* labeled here, may be positioned on and secured to the support 704 with one or more hold-down clamps. Each hold-down clamp, for example hold-down clamp 712 shown in detail in FIG. 7B, has a respective body 714, with a top lip 722, a pair of downwardly depending guide legs 716 on either side of a central screw 718 which is disposed in and secured to the body. Each pair of guide legs, for example 716, slide into a pair of selected holes for example 720 (FIG. 7A) in the sheet material support 704 and the central screw 718 is threaded in a sheet material screw hole 724 (FIG. 7A) to position top lip 722 of the hold-down clamp 702 into contact with a sheet material 702 disposed on the support 704 and to tighten the lip against the sheet material 702 and the sheet material support 704 with the screw, securing the sheet material 702 in place and holding it down. The holes in the sheet material support constrain the motion of the clamps 712 to only vertical motion. Top lip 722 applies force to the sheet material 702 contacting the sheet material support 704. The size of each top lip should be sufficient to retain the sheet material but not so big that it covers a large portion of the sheet material 702 which is to be worked on or processed. In one example the lip should not extend more than 5 mm over the edge portion of the sheet material to be worked on.

In one example, the sheet material 702*a* is secured by one pair of opposing clamps 712*a* and 712*b*. However, additional clamps, for example clamps 712*c* and 712*d*, in a linear arrangement along sheet material support 702*a* may be used to hold down the material sheet 702*a*. Material sheets 702*b* and 702*c* are held down by hold-down clamp pairs 712*b*, 712*e* and 712*d*, 712*f*, and 712*e*, 712*g* and 712*f*, 712*h*, respectively. The lip 722 of one-hold down-clamp may be used to secure adjacent sheet materials, for example, the lip 714*e* of clamp 712*e* holds-down sheet materials 702*b* and

702*c*. The support 704 may be fastened to a machine or tool or other support such as an X-Y table or work bench and may include bolt holes and bolts for fastening (not shown).

The pattern of holes allows sheet materials of different shapes and sizes, including blocks, to be supported on the material sheet support by placing the hold-down clamps in openings near the periphery of the sheet material. Referring to FIG. 7A, three holes are arranged adjacent to each other. The screw hole 724 is central to the pair of guide leg holes 720. Alternatively, the screw hole could be used as a guide leg hole and vice-versa because all the holes are the same. In one example, all of the holes are threaded at the bottom as seen with guide leg holes 720 and 729 and central screw hole 724, and the central screw 718 is longer than the pair guide legs 716 so that the central screw may be threaded into the bottom portion of the any selected hole to secure the hold-down clamp to the sheet material and to prevent twisting of the clamp. As seen with hold-down clamp 712*k*, legs 727 are inserted in threaded openings 729 and screw 725 is threaded all the way through a threaded central screw hole, not seen. In other examples, only select holes may be threaded in which case the hold-down clamp would be inserted at particular hole positions where the central screw would be threadable in that hole.

What is claimed is:

1. A hold-down clamping apparatus for securing sheet material for processing the sheet material having opposed edges to be held in place, comprising:

a plurality of hold-down clamps arranged as first parts of opposed clamping assemblies at opposed edges of a sheet material, each hold-down clamp having a body with a top lip and a downwardly depending rectangular guide beam, and a central screw disposed within the body, the top lip having a size retaining the sheet material; and a sheet material support plate arranged as second parts of the opposed clamping assemblies and having a guide beam slots in vertical alignment with the guide beam and corresponding to a rectangular cross-sectional shape of the guide beam and a central screw hole extending adjacent to the guide beam slots and in vertical alignment with the guide beam slots, the central screw threadable within the central screw hole, whereby for each clamping assembly the guide beam is insertable within the guide beam slots until the top lip of the hold-down clamp rests upon the sheet material disposed on the sheet material support plate, the central screw of each hold-down clamp being threaded into the central screw hole when the guide beam is disposed in the guide beam slots and the top lip rests upon the sheet material thereby holding down opposed edges of the sheet material upon which the top lip rests and preventing twisting of the hold-down clamp of each clamping assembly; and wherein each sheet material support plate further comprises a pair of plate members with spaced apart rectangular blocks forming the guide beam slots between the pair of plate members.

2. The apparatus of claim 1, wherein the sheet material support further comprises support retention bolt holes configured to fasten the sheet material support plate to a tool.

* * * * *